US008441408B2

(12) United States Patent
Kim et al.

(10) Patent No.: US 8,441,408 B2
(45) Date of Patent: May 14, 2013

(54) MINIATURIZED MULTIPLE INPUT MULTIPLE OUTPUT (MIMO) ANTENNA

(75) Inventors: Il-kyu Kim, Seongnam-si (KR); Chang-won Jung, Hwaseong-si (KR); Young-eil Kim, Suwon-si (KR); Jin-soo Park, Yongin-si (KR); Yong-jin Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 900 days.

(21) Appl. No.: 11/937,075

(22) Filed: Nov. 8, 2007

(65) Prior Publication Data

US 2009/0009400 A1 Jan. 8, 2009

(30) Foreign Application Priority Data

Jul. 3, 2007 (KR) ..... 10-2007-0066611

(51) Int. Cl.
*H01Q 1/38* (2006.01)
*H01Q 1/48* (2006.01)
*H01Q 21/00* (2006.01)

(52) U.S. Cl.
USPC ..... 343/848; 343/700 MS; 343/893

(58) Field of Classification Search ..... 343/846, 343/700 MS, 893, 848
See application file for complete search history.

(56) References Cited

U.S. PATENT DOCUMENTS

| | | | | |
|---|---|---|---|---|
| 6,549,170 | B1 * | 4/2003 | Kuo et al. | 343/702 |
| 7,106,256 | B2 | 9/2006 | Watanabe et al. | |
| 7,245,259 | B2 * | 7/2007 | Puckey et al. | 343/700 MS |
| 7,289,068 | B2 * | 10/2007 | Fujio et al. | 343/700 MS |
| 7,629,930 | B2 * | 12/2009 | Murch et al. | 343/700 MS |
| 2005/0110683 | A1 * | 5/2005 | Song et al. | 343/700 MS |
| 2006/0038723 | A1 | 2/2006 | Watanabe et al. | |

FOREIGN PATENT DOCUMENTS

| | | |
|---|---|---|
| JP | 2005167966 A | 6/2005 |
| KR | 100699472 | 3/2007 |

* cited by examiner

*Primary Examiner* — Robert Karacsony
(74) *Attorney, Agent, or Firm* — Sughrue Mion, PLLC

(57) ABSTRACT

A miniaturized multiple input multiple output (MIMO) antenna includes a first antenna element disposed in a first side of a substrate in a round form; a second antenna element in a round form symmetrically with the first antenna element and disposed in the first side of the substrate; and a ground disposed in a second side of the substrate. The first antenna element and the second antenna element are disposed such that electro magnetic waves resonating in the first antenna element and the second antenna element are orthogonally polarized. Accordingly, the antenna size can be reduced. The miniaturized antenna facilitates the component design in the small terminal.

10 Claims, 10 Drawing Sheets

2.4GHz Pattern 3.5GHz Pattern 5.55GHz Pattern 2.4GHz Pattern 3.5GHz Pattern 5.55GHz Pattern

MINIATURIZED MULTIPLE INPUT MULTIPLE OUTPUT (MIMO) ANTENNA

CROSS-REFERENCE TO RELATED APPLICATIONS

This application claims priority from Korean Patent Application No. 10-2007-0066611, filed on Jul. 3, 2007, in the Korean Intellectual Property Office, the disclosure of which is incorporated herein by reference in its entirety.

BACKGROUND OF THE INVENTION

1. Field of the Invention

Apparatuses consistent with the present invention relate to a multiple input multiple output (MIMO) antenna. More particularly, the present invention relates to a miniaturized MIMO antenna.

2. Description of the Related Art

With demands for multimedia services of high quality using a wireless mobile communication technology, a next-generation radio transmission technique is required to send much data at a higher data rate with a lower error probability.

To respond to this demand, a multiple input multiple output (MIMO) antenna is suggested. The MIMO antenna performs the MIMO operation by arranging a plurality of antenna elements in a specific structure. The MIMO antenna sharpens the overall radiation pattern and enables the farther propagation of the electro magnetic wave by matching the radiation patterns and the radiation powers of the antenna elements.

Accordingly, it is possible to increase the data rate in a certain range or to extend the system range at a specific data rate. The MIMO antenna, which is the next-generation mobile communication technique prevalently applicable to a mobile communication terminal and a repeater, is attracting attention as the next-generation technique by overcoming the limited transmission quantity caused by the expansion of the data communications.

However, it is quite hard to implement the MIMO antenna using the conventional antenna element because the MIMO antenna requires a smaller antenna element to install the multiple antenna elements within the small terminal. Therefore, the antenna element should be miniaturized to implement the MIMO system in accordance with the miniaturization of the terminal.

In addition, to install the MIMO antenna in the small terminal, the interval between the antenna elements has to be narrow. In this situation, the electro magnetic waves radiated from the antenna elements may interfere with each other. Further, the antenna embedded in the small terminal restricts the position of the other installed components.

The above shortcomings are applied to not only the MIMO antenna but also an array antenna including a plurality of antenna elements and a dual- or multi-band antenna.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a MIMO antenna for reducing a size of antenna elements while maintaining a performance of the antenna.

The present invention provides an antenna for increasing isolation by preventing interference of electro magnetic waves radiated from antenna elements in the design phase of the antenna including a plurality of antenna elements.

According to an aspect of the present invention, there is provided a multiple input multiple output (MIMO) antenna comprising a first antenna element disposed in a first side of a substrate in a round form; a second antenna element in a round form symmetrically with the first antenna element and disposed in the first side of the substrate; and a ground disposed in a second side of the substrate. The first antenna element and the second antenna element may be disposed such that electro magnetic waves resonating in the first antenna element and the second antenna element are orthogonally polarized.

The round form may be an oval.

A minor axis of the first antenna element may be at right angle to a minor axis of the second antenna element.

A minor axis of the first antenna element may be tilted at 45 degrees from a horizontal side of the substrate, and a minor axis of the second antenna element may be titled at −45 degrees from the horizontal side of the substrate.

The ground may comprise a first ground and a second ground disposed in the second side of the substrate; and a third ground disposed below the first and second grounds. Part of the second side where the first ground is disposed may correspond to part of the first side where the first antenna element is disposed, and part of the second side where the second ground is disposed may correspond to part of the first side where the second antenna element is disposed.

The MIMO antenna may comprise two feeders which feed power to the first antenna element and the second antenna element. The feeder may be in a form of line, and a length of the feeder is longer than a vertical side of the third ground.

The first ground and the second ground may be in a form of a rectangular and symmetrical with each other.

A vertical slot may be disposed at a center of an upper end of a third ground.

The ground may comprise a first connector which interconnects the first ground and the third ground; and a second connector which interconnects the second ground ad the third ground.

The first connector and the second connector may be symmetrical with each other.

The first connector and the second connector may be bent at least one time.

According to another aspect of the present invention, there is provided a MIMO antenna comprising a plurality of antenna elements disposed in a first side of a substrate, symmetrical with each other based on a center of the substrate, and in a form of a round; and a ground disposed in a second side of the substrate. Part of the second side where the ground may be formed corresponds to part of the first side where the antenna elements are disposed.

The ground may comprise a first ground and a second ground disposed in the second side of the substrate; and a third ground disposed below the first and second grounds. Part of the second side where the first ground is disposed may correspond to part of the first side where the first antenna element is disposed, and part of the second side where the second ground is disposed may correspond to part of the first side where the second antenna element is disposed.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1A:
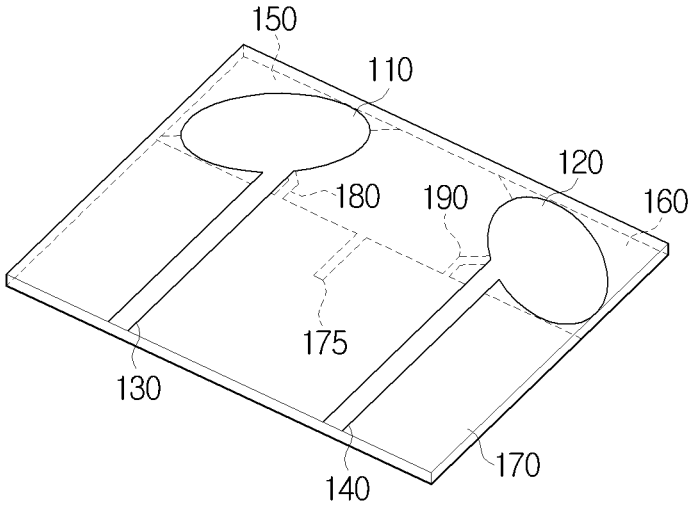
FIGS. 1A, 1B and 1C are conceptual diagrams of a MIMO antenna according to an exemplary embodiment of the present invention.

Certain exemplary embodiments of the present invention will now be described in greater detail with reference to the accompanying drawings.

In the following description, same drawing reference numerals are used for the same elements even in different drawings. The matters defined in the description, such as detailed construction and elements, are provided to assist in a comprehensive understanding of the invention. Thus, it is apparent that the exemplary embodiments of the present invention can be carried out without those specifically defined matters. Also, well-known functions or constructions are not described in detail since they would obscure the invention with unnecessary detail.

Figure 1B:
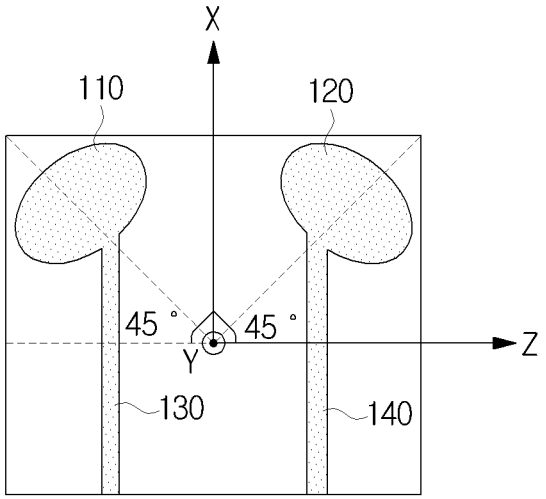
Figure 1C:
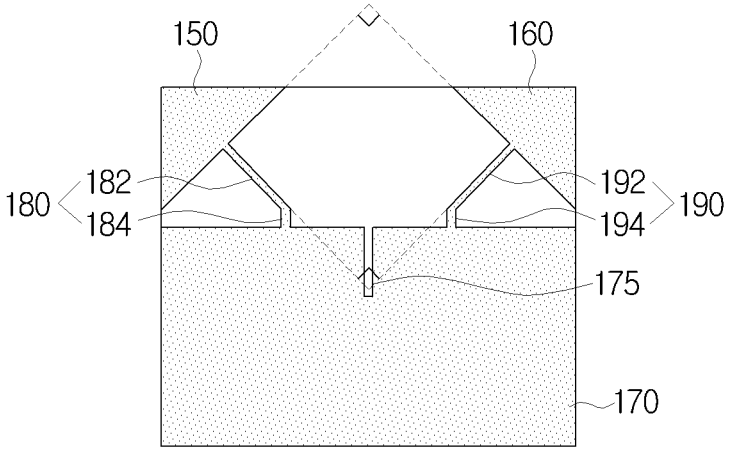

FIGS. 1A, 1B and 1C are conceptual diagrams of a multiple input multiple output (MIMO) antenna according to an exemplary embodiment of the present invention. FIG. 1A is a perspective view of a miniaturized MIMO antenna printed on a substrate, FIG. 1B is a front view of the MIMO antenna of FIG. 1A, and FIG. 1C is a rear view of the MIMO antenna of FIG. 1A. While the MIMO antenna is illustrated by way of example, the present invention is applicable to an array antenna including a plurality of antenna elements, and a dual- or multi-band antenna.

In the MIMO antenna, two antenna elements and two feeders are disposed in a front side of a substrate. One main ground, two supplemental grounds, and two connectors are disposed in a rear side of the substrate.

Preferably, the substrate is a printed circuit board (PCB) to facilitate the manufacture by printing a simplified planar antenna on the PCB.

As shown in FIG. 1B, the two antenna elements including a first antenna element 110 and a second antenna element 120 radiate electro magnetic waves and are disposed in the front side of the substrate as far from each other as possible. Preferably, the first antenna element 110 and the second antenna element 120 are symmetrical and in a round form. The round form is oval. The oval antenna element functions as a multi-band antenna. The electro magnetic waves of different frequencies radiate according to the trace of the current distribution formed in the oval.

The first antenna element 110 and the second antenna element 120 are disposed such that the electro magnetic waves are orthogonally polarized and that the minor axis of the first antenna element 110 and the minor axis of the second element axis 120 form 90 degrees. Preferably, the minor axis of the first antenna element 110 is tilted at 45° and the minor axis of the second antenna element 120 is tilted at −45° based on the horizontal side of the substrate. By disposing the first and second antenna elements 110 and 120 in the orthogonal polarization direction, the electro magnetic waves radiated from the antenna elements have high isolation.

The two feeders including a first feeder 130 and a second feeder 140 each feed power to the first antenna element 110 and the second antenna element 120. Preferably, the feeders 130 and 140 are in a form of a strip line. The first feeder 130 and the second feeder 140 are connected to a lower end of the substrate to receive external electro magnetic energy. Hence, the supplied electro magnetic energy is fed to the antenna elements and the antenna elements radiate the electro magnetic waves.

Preferably, the first feeder 130 and the second feeder 140 are connected to the areas of the minor axes of the first antenna element 110 and the second antenna element 120 respectively, and are longer than the length of a main ground 170, to be explained. Accordingly, the effect of the main ground 170 on the external elector magnetic energy supplied through the first feeder 130 and the second feeder 140 can be minimized.

When the first antenna element 110 and the second antenna element 120 are disposed within their mutual radiation area, the electro magnetic waves radiated from the first antenna element 110 and the second antenna element 120 are propagated to recipient antenna elements. However, since the first antenna element 110 and the second antenna element 120 are disposed in the orthogonal polarization direction, the electro magnetic waves radiated from the first antenna element 110 and the second antenna element 120 does not cause interference to thus achieve the high isolation.

The conventional MIMO antenna needs the interval over 18 mm between the antennas to acquire the isolation below −10 dB. When the antenna elements are disposed in the orthogonal polarization direction according to the present invention, the interval of 14 mm is needed to achieve the same isolation. As a result, the antenna miniaturization can be realized.

Three grounds 150, 160 and 170, and connectors 180 and 190 for interconnecting the grounds 150, 160 and 170 are disposed in the rear side of the substrate. The antenna can be miniaturized by utilizing both sides of the substrate with the antenna elements 110 and 120 and the feeders 130 and 140 in the front side and the grounds 150, 160 and 170 in the rear side.

Part of the rear side where the first ground 150 is disposed corresponds to part of the front side where the first antenna element 110 is disposed. Part of the rear side where the second ground 160 is disposed corresponds to part of the front side where the second antenna element 120 is disposed. Part of the rear side where the third ground 170 is disposed corresponds to part of the front side where the two feeders 130 and 140 are disposed. The first ground 150 and the second ground 160 can be referred to as supplementary grounds, and the third ground 170 can be called as a main ground.

Preferably, half of the areas corresponding to the first antenna element 110 and the second antenna element 120 corresponds to part of the areas of the first ground 150 and the second ground 160, and are formed in the symmetrical structure. Preferably, when the first ground 150 and the second ground 160 are in a right triangle shape respectively, their diagonal lines are orthogonal.

Part of the areas of the first ground 150 and the second ground 160 corresponds to part of the areas of the first antenna element 110 and the second antenna elements 120, to thus increase capacitance. Hence, the miniaturized antenna can resonate in the low frequency band.

In addition to the main ground 170, the first ground 150 and the second ground 160, which are the supplemental grounds, are designed in the rear side of the substrate. Thus, it is possible to reduce the antenna size to 75% compared to the antenna size including one ground. Since the distance between the two antennas becomes longer according to the reduced antenna size, the isolation far more increases.

Preferably, a vertical slot 175 is disposed at the center of the upper end of the third ground 170. The vertical slot 175 blocks an unnecessary signal flow between the first antenna element 110 and the second antenna element 120 and extends the current path. Particularly, when the antenna resonates in 2~6 GHz band, the vertical slot 175 is required to increase the isolation in 5 GHz band. Preferably, the length of the vertical slot 175 is λ/4 of 5 GHz band frequency, where λ is a wavelength. Since the vertical slot 175 is used to increase the isolation in a specific frequency band, it may be unnecessary when frequency other than the specific frequency is used as the operating frequency.

The first connector 180 interconnects the first ground 150 and the third ground 170, and the second connector 190 interconnects the second ground 160 and the third ground 170. Preferably, the first connector 180 and the second connector 190 are bent one time in a line shape in a symmetrical structure. By bending the connectors 180 and 190 one time, the radiation of the high frequency electro magnetic waves can be increased.

In specific, the first connector 180 comprises a first strip line 182 tilted at −45° from the horizontal side of the substrate and connected to the first ground 150 with one end, and a second strip line 184 in parallel with the horizontal side of the substrate and connected to the first strip line 182 with one end and connected to the third ground 170 with the other end. The second connector 190 comprises a third strip line 192 tilted at 45° from the horizontal side of the substrate and connected to the second ground 160 with one end, and a fourth strip line 194 in parallel with the vertical side of the substrate and connected to the third strip line 192 with one end and connected to the third ground 170 with the other end.

With the antenna designed as above, the antenna miniaturization can be realized more easily than a MIMO antenna using a three-dimensional structure or diode and varactor.

Figure 2A:
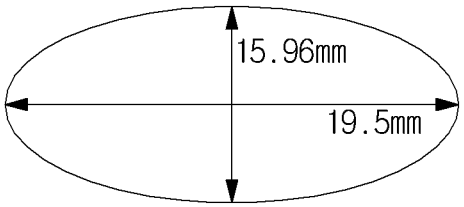
FIGS. 2A and 2B are diagrams for comparing a size of the antenna element according to the presence and the absence of a supplemental ground.
Figure 2B:
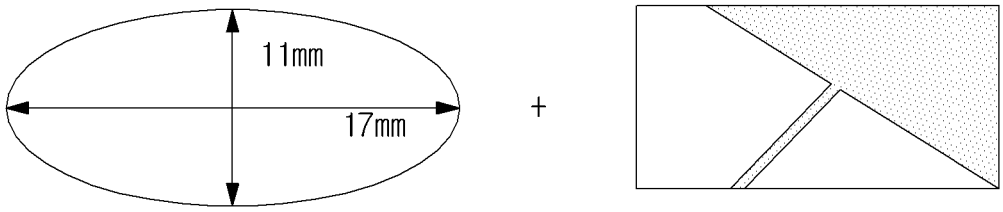

FIGS. 2A and 2B are diagrams for comparing the size of the antenna element according to the presence and the absence of the supplemental ground. To resonate in 2~6 GHz bands, the antenna without the supplemental ground requires the oval antenna element of the minor axis 15.96 mm and the major axis 19.5 mm as shown in FIG. 2A. The antenna with the supplemental ground requires the oval antenna element of the minor axis 11 mm and the major axis 17 mm as shown in FIG. 2B. Thus, the antenna can be miniaturized by reducing the size of the antenna element up to 40% or so.

Figure 3:
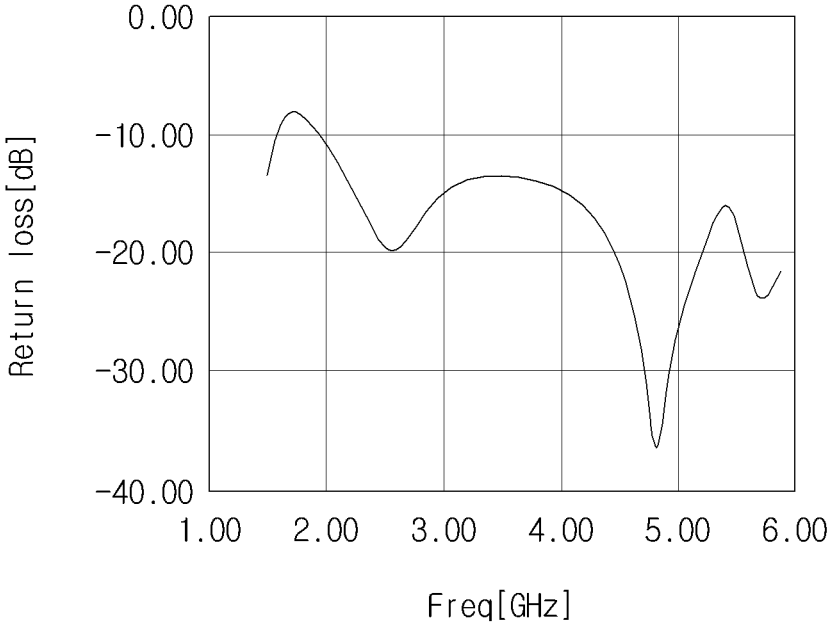
FIG. 3 is a graph showing an isolation between a first antenna element and a second antenna element when a vertical slot is disposed at the center of a third ground.

FIG. 3 is a graph showing the isolation between the second antenna element 120 and the first antenna element 110 when the vertical slot 175 is disposed at the center of the third ground 170.

When the slot 175 of ¼ size of the wavelength in the frequency 5 GHz is vertically disposed at the center of the third ground 170, the isolation in 5 GHz band is reduced by −15 dB and the isolation in 2~6 GHz bands is also reduced below −10 dB as shown in FIG. 3.

Figure 4:
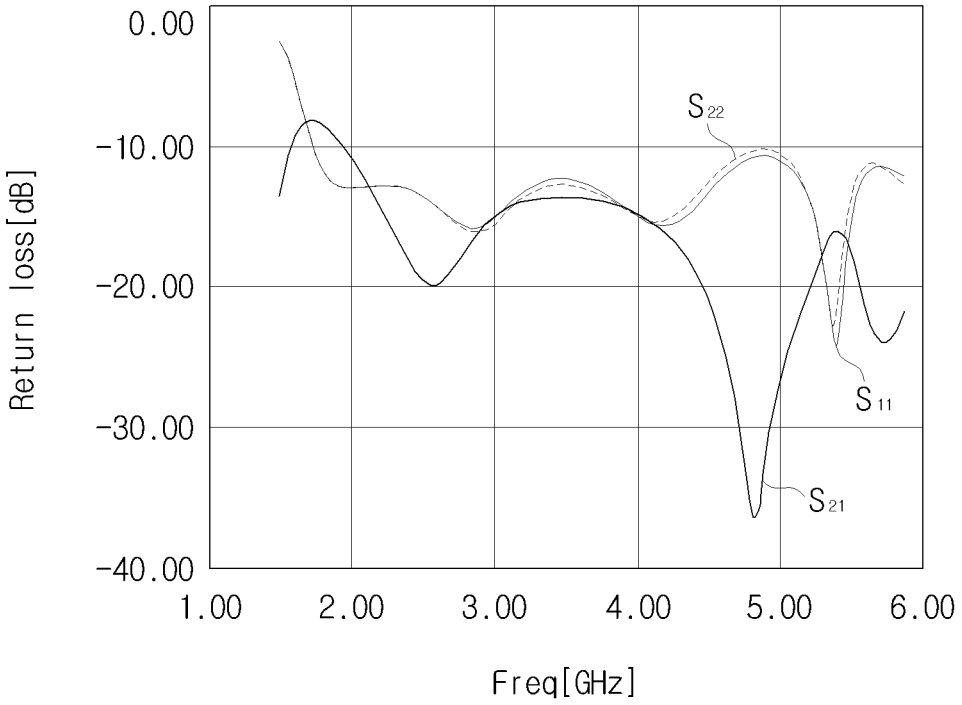
FIG. 4 is a graph showing a return loss in 2~6 GHz bands.

FIG. 4 is a graph showing a return loss in 2~6 GHz bands. $S_{11}$ indicates the resonation of the first antenna element 110 in 2~6 GHz bands, and $S_{22}$ indicates the resonation of the second antenna element 120 in 2~6 GHz bands. As one can see from FIG. 4, the first antenna element 110 and the second antenna element 120 maintain the resonance below −10 dB in 2~6 GHz bands. $S_{21}$ indicates the isolation between the first antenna element 110 and the second antenna element 120. The isolation between the first antenna element 110 and the second antenna element 120 is below −10 dB in 2~6 GHz bands as well. Hence, the two antenna elements in the orthogonal polarization direction can be used in six or more mode bands. The six or more mode bands comprise Wibro, 11b, 11G, Mobile Wimax in U.S.A, Mobile Wimax in Europe, and 11N.

Figure 5A:
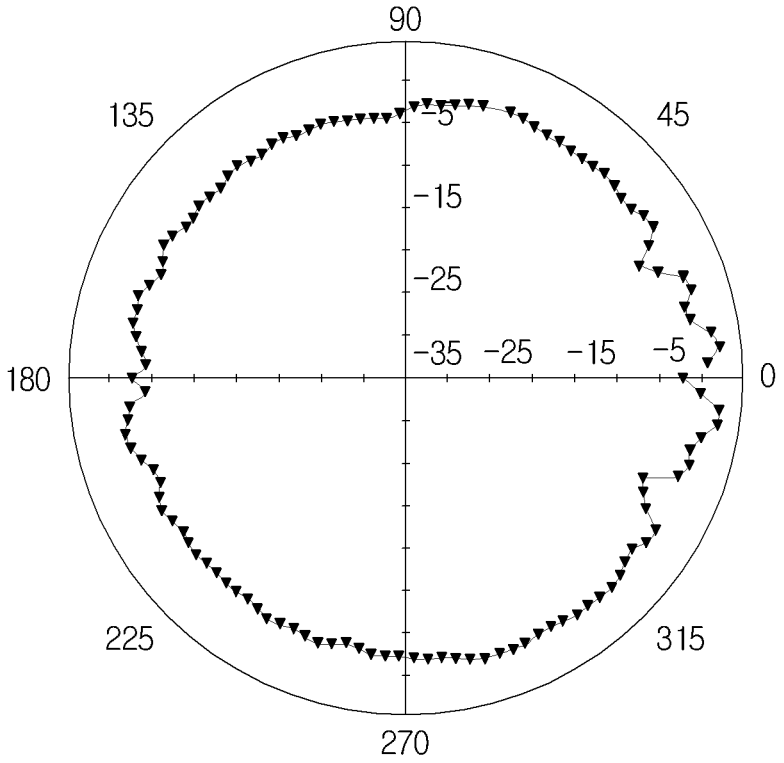
FIGS. 5A, 5B and 5C show the beam pattern of the electro magnetic wave according to the frequency bands in an XY plane of the substrate.
Figure 5B:
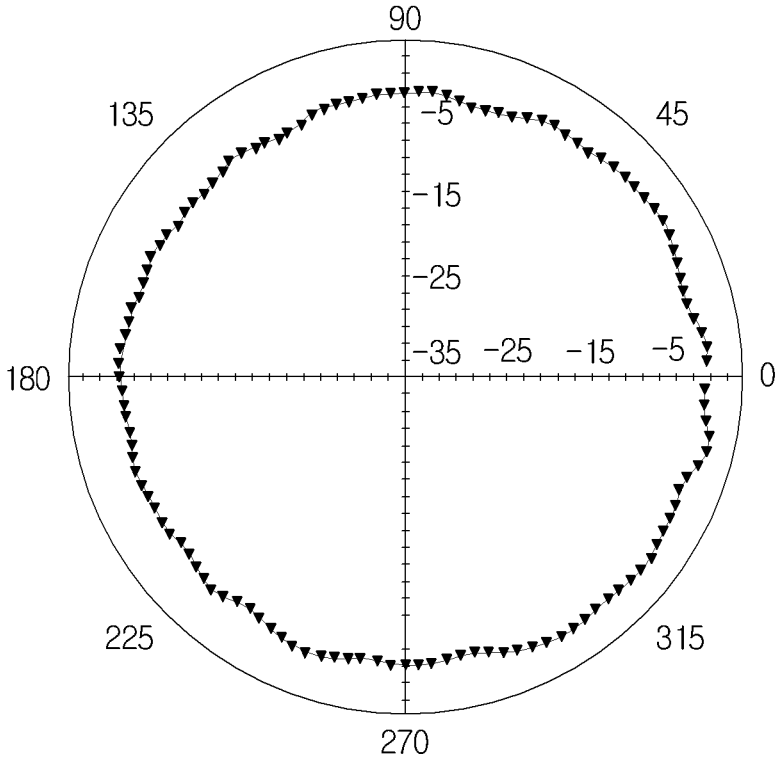
Figure 5C:
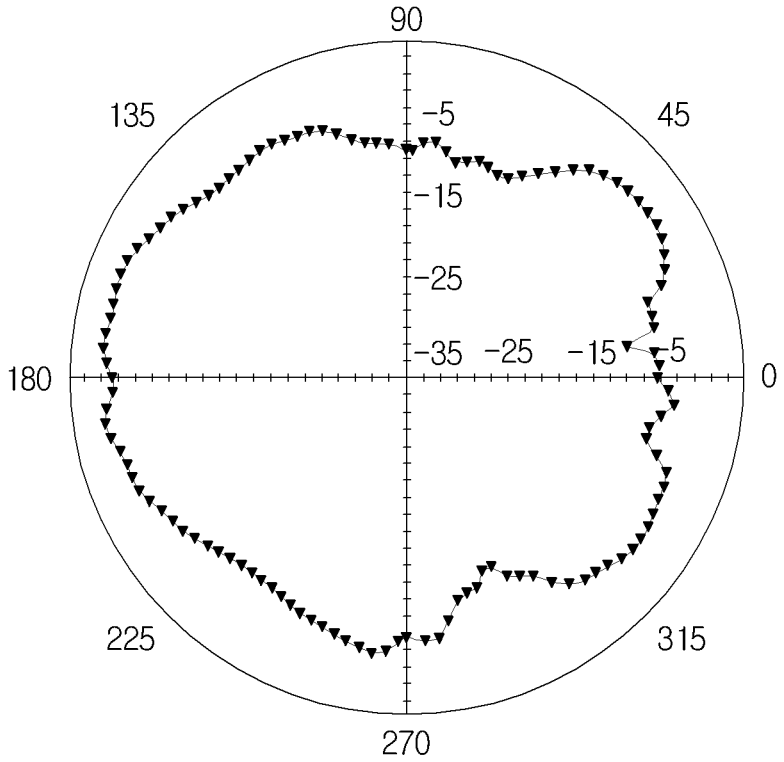
Figure 6A:
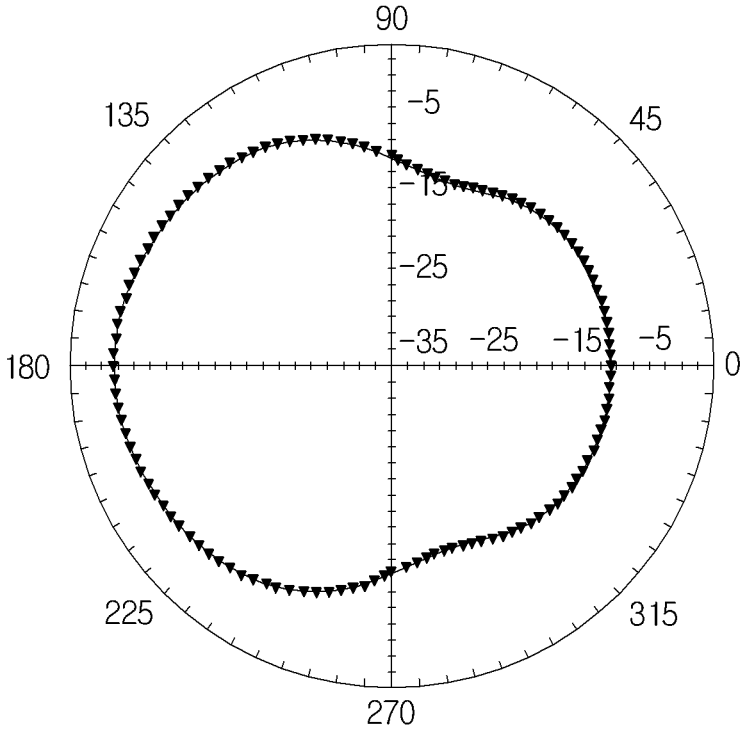
FIGS. 6A, 6B and 6C show the beam pattern of the electro magnetic wave according to the frequency bands in an YZ plane of the substrate.
Figure 6B:
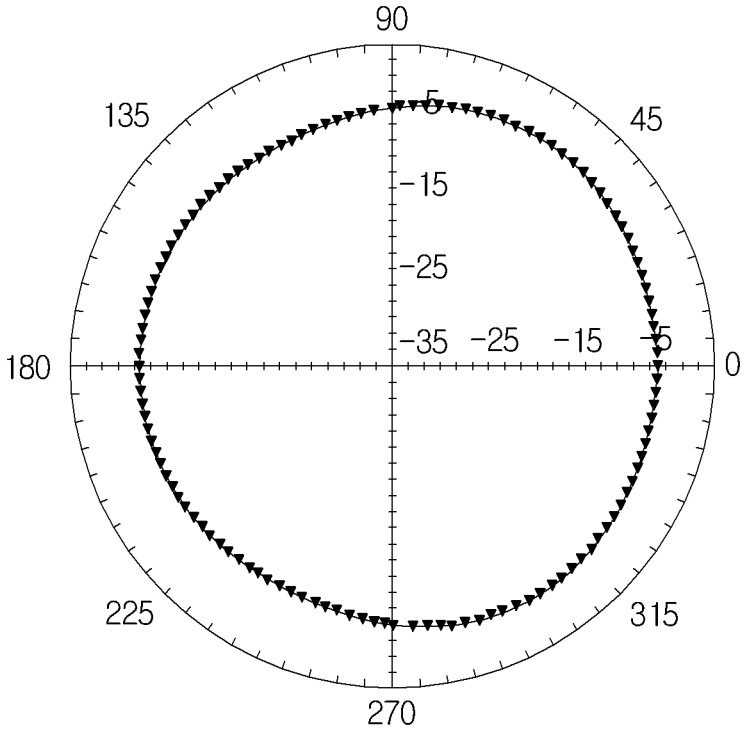
Figure 6C:
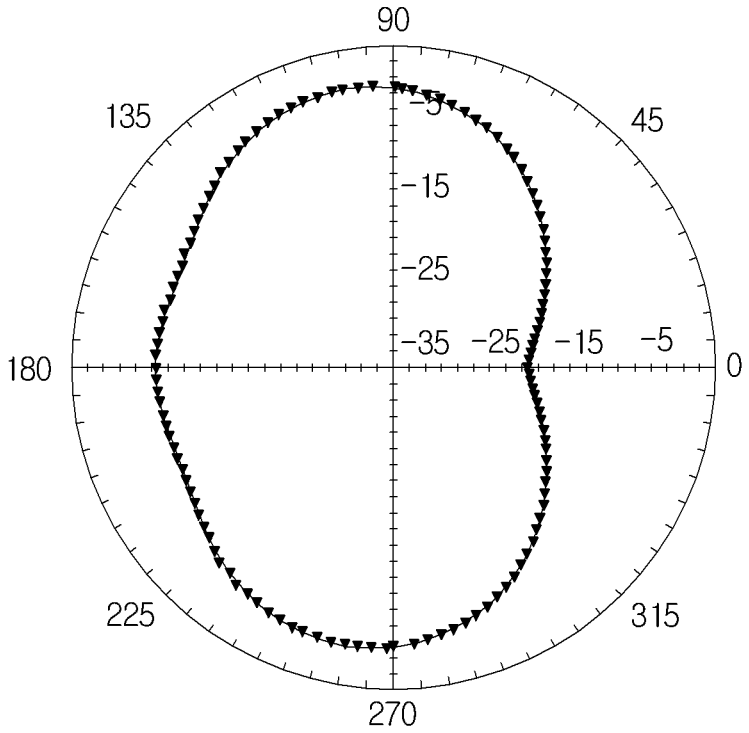

FIGS. 5A, 5B and 5C show the beam pattern of the electro magnetic wave according to the frequency bands in an XY plane of the substrate, and FIGS. 6A, 6B and 6C show the beam pattern of the electro magnetic wave according to the frequency bands in an YZ plane of the substrate. The definitions of the XY plane and the YZ plane are shown in FIG. 1B. As shown in FIGS. 5A through 6C, the antenna of the present invention can resonate in the multi-band and its radiation pattern is omni-directional.

As set forth above, the antenna size can be reduced by using the supplemental ground. Therefore, the component design in the small terminal is unrestricted.

When the antenna including a plurality of antenna elements is designed, the isolation can be increased by preventing the interference of the electro magnetic waves radiated from the antenna elements.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A multiple input multiple output (MIMO) antenna comprising:

a first antenna element disposed on a first side of a substrate in a round form;

a second antenna element in a round form symmetrically with the first antenna element and disposed on the first side of the substrate; and a ground disposed on a second side of the substrate, wherein the first antenna element and the second antenna element are disposed such that electro magnetic waves resonating in the first antenna element and the second antenna element are orthogonally polarized, wherein a whole form of the first antenna element and the second antenna element has a round form respectively, wherein the ground comprises:

a first ground and a second ground disposed on the second side of the substrate;

a third ground disposed below the first and second grounds;

a first connector which directly interconnects the first ground and the third ground; and a second connector which directly interconnects the second ground and the third ground, wherein a part of the first ground faces a part of the first antenna element, and a part of the second ground faces a part of the second antenna element.

2. The MIMO antenna of claim 1, wherein the round form is an oval.

3. The MIMO antenna of claim 2, wherein a minor axis of the first antenna element is at a right angle to a minor axis of the second antenna element.

4. The MIMO antenna of claim 2, wherein a minor axis of the first antenna element is tilted at 45 degrees from a horizontal side of the substrate, and a minor axis of the second antenna element is titled at −45 degrees from the horizontal side of the substrate.

5. The MIMO antenna of claim 1, further comprising:

two feeders which feed power to the first antenna element and the second antenna element, wherein the two feeders are in a form of a line, and a length of the feeder is longer than a vertical side of the third ground.

6. The MIMO antenna of claim 1, wherein the first ground and the second ground are in a form of a triangle and symmetrical with each other.

7. The MIMO antenna of claim 1, wherein a vertical slot is disposed at a center of an upper end of the third ground.

8. The MIMO antenna of claim 1, wherein the first connector and the second connector are symmetrical with each other.

9. The MIMO antenna of claim 1, wherein the first connector and the second connector are bent at least one time.

10. A multiple input multiple output (MIMO) antenna comprising:

a plurality of antenna elements disposed on a first side of a substrate, symmetrical with each other based on a center of the substrate, and in a round form; and a ground disposed on a second side of the substrate, wherein a whole form of the first antenna element and the second antenna element has a round form respectively, wherein the ground comprises:

a first ground and a second ground disposed on the second side of the substrate;

a third ground disposed below the first and second grounds;

a first connector which directly interconnects the first ground and the third ground; and a second connector which directly interconnects the second ground and the third ground, wherein a part of the first ground faces a part of the first antenna element, and a part of the second ground faces a part of the second antenna element.

* * * * *